US007467905B2

(12) United States Patent
Habatjou

(10) Patent No.: US 7,467,905 B2
(45) Date of Patent: Dec. 23, 2008

(54) APPLICATOR, AND A PACKAGING AND DISPENSER DEVICE INCLUDING SUCH AN APPLICATOR

(75) Inventor: Jacques Habatjou, Cambrai (FR)

(73) Assignee: L'Oreal, Paris (FR)

( * ) Notice: Subject to any disclaimer, the term of this patent is extended or adjusted under 35 U.S.C. 154(b) by 547 days.

(21) Appl. No.: 11/124,055

(22) Filed: May 9, 2005

(65) Prior Publication Data

US 2005/0249539 A1 Nov. 10, 2005

Related U.S. Application Data

(60) Provisional application No. 60/572,752, filed on May 21, 2004.

(30) Foreign Application Priority Data

May 7, 2004 (FR) ..... 04 50890

(51) Int. Cl.
*A46B 11/00* (2006.01)

(52) U.S. Cl. ..... 401/127; 401/126

(58) Field of Classification Search ..... 401/118, 401/121, 122, 126, 127, 129; 132/216, 218, 132/223, 317; 15/165, 212, 104.19, 201
See application file for complete search history.

(56) References Cited

U.S. PATENT DOCUMENTS

| | | | | |
|---|---|---|---|---|
| 347,671 | A * | 8/1886 | Webb | 15/212 |
| 2,432,924 | A * | 12/1947 | Nishizaka et al. | 15/212 |
| 3,998,235 | A | 12/1976 | Kingsford | |
| 4,446,880 | A | 5/1984 | Gueret et al. | |
| 4,498,490 | A | 2/1985 | Seidler | |
| 4,869,612 | A * | 9/1989 | Mooney et al. | 401/130 |
| 5,722,436 | A | 3/1998 | Vandromme et al. | |
| 6,345,626 | B1 | 2/2002 | Bouix | |

FOREIGN PATENT DOCUMENTS

| | | |
|---|---|---|
| FR | 2 506 581 | 5/1984 |

* cited by examiner

*Primary Examiner*—David J Walczak
(74) *Attorney, Agent, or Firm*—Oliff & Berridge, PLC

(57) ABSTRACT

An applicator may include a support with a longitudinal axis. The support may include a stem, and a deformable portion including a first end and a second end, the deformable portion being arranged to deform elastically in a radial direction when a distance between the first and second ends is varied. The applicator may also include an applicator member fitted to the deformable portion between the first and second ends and extending continuously around the deformable portion. An adjuster element may be provided that is movable about at least the axis relative to the support and that is arranged to adjust the distance between the first and second ends of the deformable portion.

35 Claims, 6 Drawing Sheets

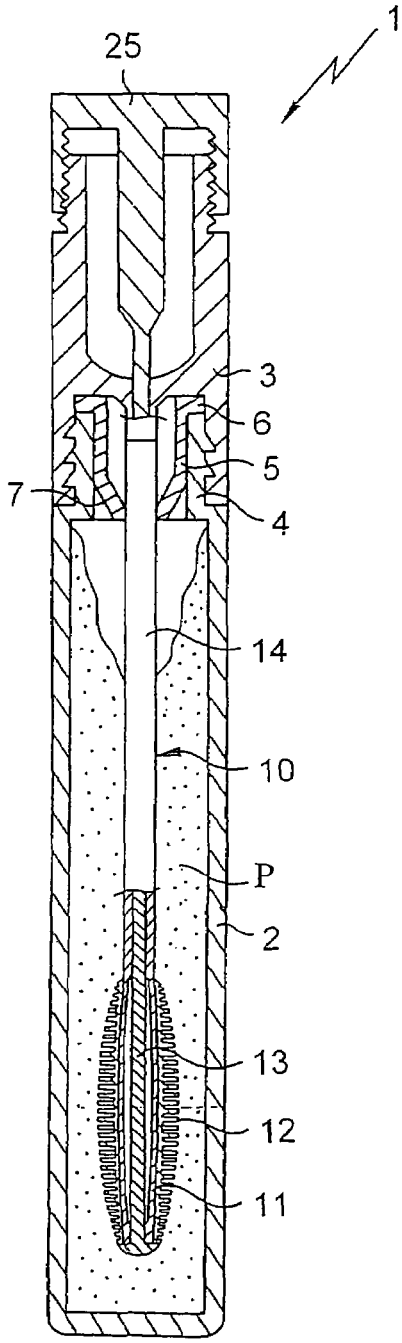
Fig.1
Fig.2
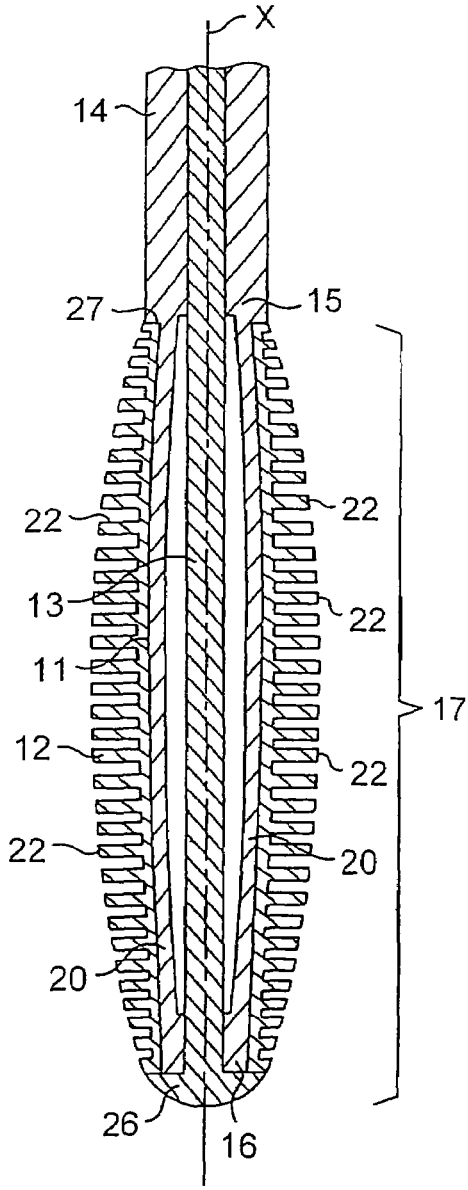

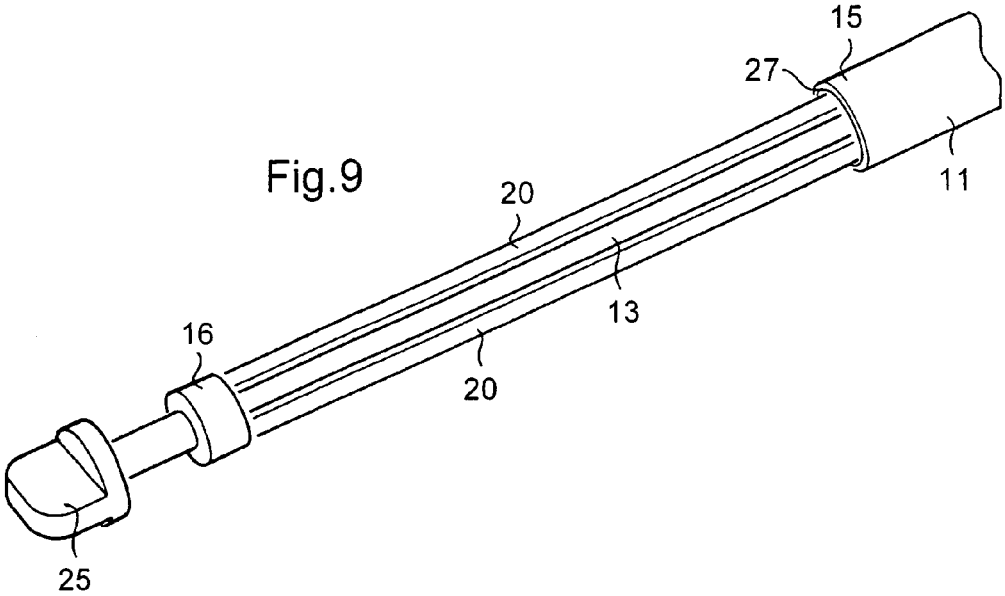
Fig.9
Fig.10
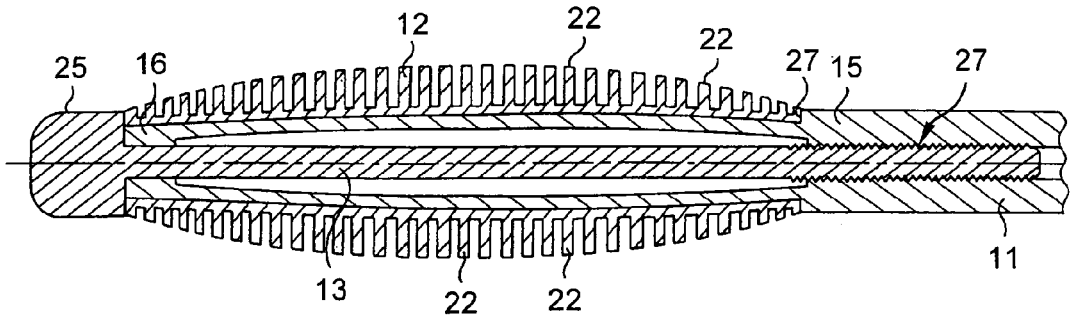
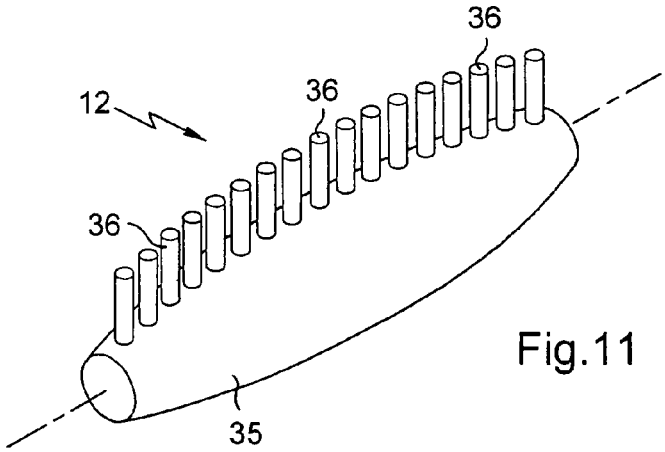
Fig.11

Fig.12
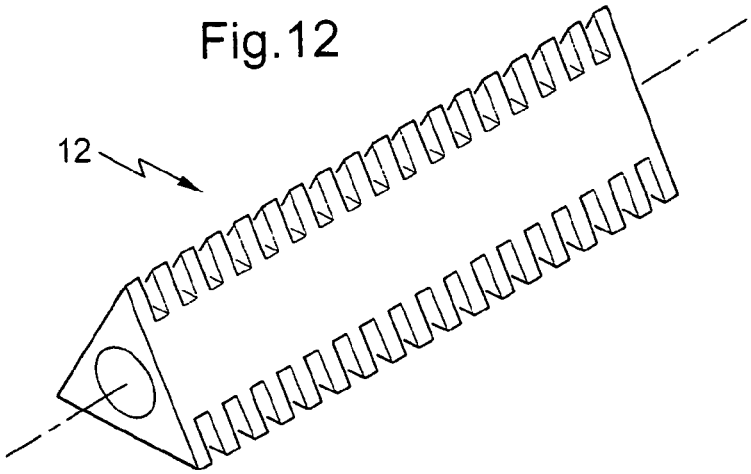
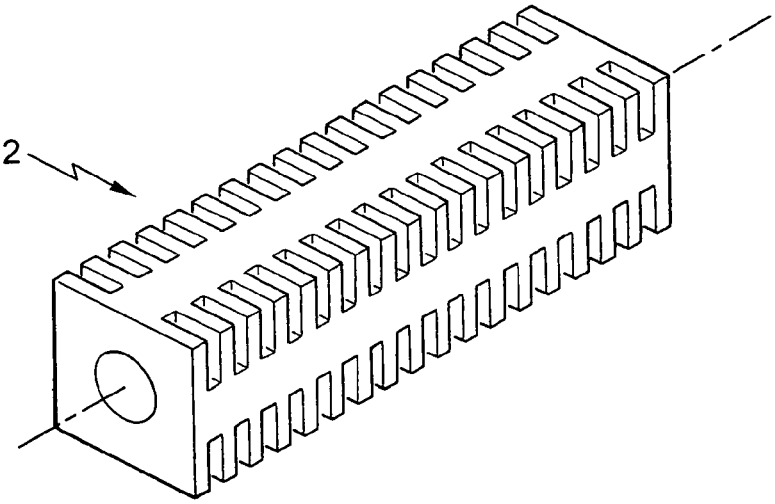
Fig.13
Fig.14
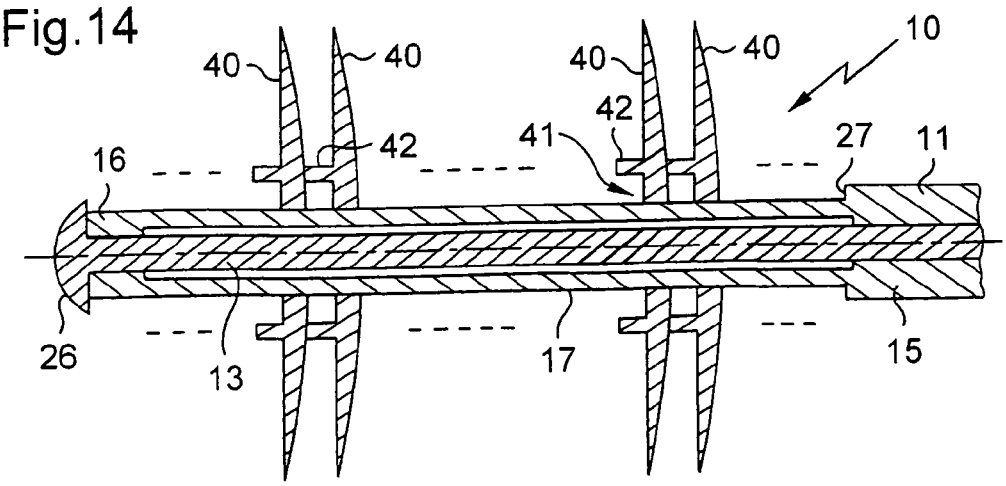

Fig.15
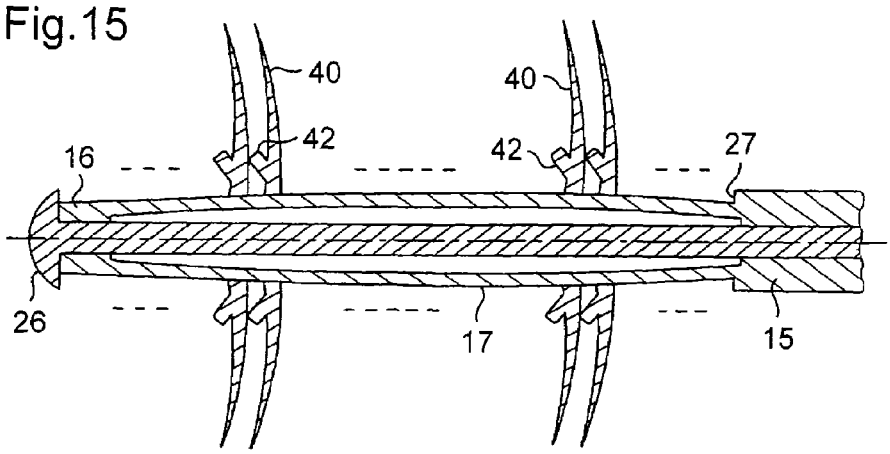
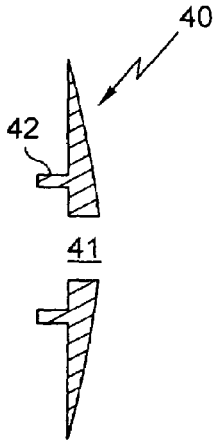
Fig.16
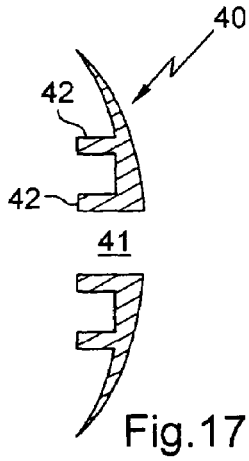
Fig.17
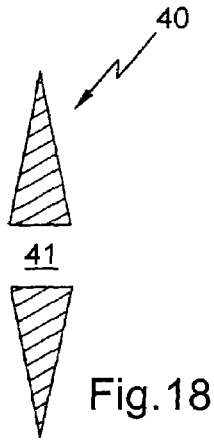
Fig.18
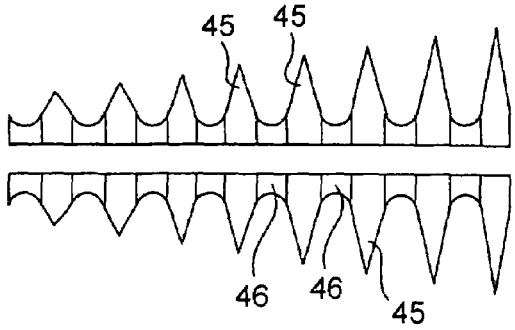
Fig.19
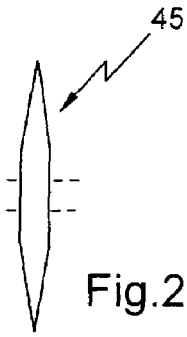
Fig.20
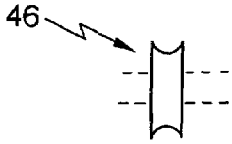
Fig.21

APPLICATOR, AND A PACKAGING AND DISPENSER DEVICE INCLUDING SUCH AN APPLICATOR

CROSS-REFERENCE TO RELATED APPLICATION

This non-provisional application claims the benefit of French Application No. 04 50890 filed on May 7, 2004, and U.S. Provisional Application No. 60/572,752 filed on May 21, 2004.

BACKGROUND

The present invention relates to applicators for applying a substance, for example, a cosmetic, and to packaging and dispenser devices including such applicators.

More particularly, the invention relates to applicators for applying a substance, for example, mascara, to keratinous fibers, for example, eyelashes or eyebrows.

The flexibility and the bristle or tooth position characteristics of a majority of known mascara brushes or combs are fixed.

U.S. Pat. Nos. 3,998,235 and 5,722,436 describe applicators comprising applicator elements with a separation that may be adjusted by the user. In such applicators, the distance between the applicator elements is modified by applying a compressive force along the longitudinal axis of the applicator. Further, U.S. Pat. No. 6,345,626 describes an applicator comprising a plurality of independent disks suitable for being axially pressed together while the applicator is being withdrawn from the receptacle containing the substance to be applied.

Further, French patent application FR-A-2,506,581 describes an applicator including a sleeve provided with four slits. The diameter of the sleeve may be varied under the action of a stem sliding in a hollow handle of the brush and having an end that displaces a first end of the sleeve, the second end of the sleeve being held stationary by the hollow handle. The user may elect to position the handle in a minimum-diameter position or in a maximum-diameter position. Substance may penetrate inside the sleeve via the slits, and then between the hollow sleeve and the sliding stem. The substance accumulated inside the sleeve escapes during wiping and there may be a risk of dirtying.

SUMMARY

Mascara applicators should retain a sufficient quantity of mascara to avoid a need for overly-frequent re-loading during application. Further, such applicators should be able to grip the lashes, separate them, extend them and/or curl them, depending on the type of makeup desired. Users may find it difficult to control the quantity of substance loaded onto the brush or comb of known applicators.

There exists a need, prior to application and/or during use, to be able to modify an applicator to adapt to the shape, number, disposition, thickness, flexibility, and length of eyelashes or eyebrows of a person, to the rheology of the substance, and/or to the desired type of makeup.

Exemplary embodiments of the invention provide an applicator comprising:

- a support with a longitudinal axis X, the support comprising: a stem; and a deformable portion including a first end and a second end, the deformable portion being arranged to deform elastically in a radial direction when a distance between the first and second ends is varied;

- an applicator member fitted to the deformable portion between the first and second ends and extending continuously around the deformable portion; and
- an adjuster element that is movable at least along the axis X relative to the support and that is arranged to adjust the distance between the first and second ends of the deformable portion.

When the distance between the first and second ends is varied, the radial deformation of the deformable portion may cause deformation of the applicator member.

In exemplary embodiments, a user may use the adjuster element to progressively modify shape and/or curvature of the applicator member. To apply mascara, for example, the applicator may be adjusted as a function of the makeup which is to be applied. By adjusting an outside cross-section of the applicator member, the quantity of substance with which the applicator is loaded may be adjusted.

If desired, the applicator member may readily be produced so as to substantially prevent the substance from reaching the deformable portion. The applicator member may advantageously be produced without longitudinal slits, for example.

In exemplary embodiments, the applicator member may be fitted to the deformable portion of the support. I such embodiments, a plurality of devices with identical supports but different applicator members may readily be produced.

Independently or in combination with the above, exemplary embodiments of the invention provide an applicator comprising:

- a support with a longitudinal axis X, comprising: a stem; and a deformable portion including a first end and a second end, the deformable portion being arranged to deform elastically in a radial direction when a distance between the first and second ends is varied;
- an applicator member comprising a sleeve fitted to the deformable portion between the first and second ends, said sleeve defining a closed surface surrounding the deformable portion and carrying at least one applicator element; and
- an adjuster element that is movable at least along the axis X relative to the support and that is arranged to adjust the distance between the first and second ends of the deformable portion.

Independently or in combination with the above, exemplary embodiments of the invention provide an applicator comprising:

- a support with a longitudinal axis X, comprising: a stem; and a deformable portion including a first end and a second end, the deformable portion being arranged to deform elastically in a radial direction when a distance between the first and second ends is varied;
- a plurality of disks fitted between the first and second ends on the deformable portion; and
- an adjuster element that is movable at least along the axis X relative to the support and that is arranged to adjust the distance between the first and second ends of the deformable portion.

Independently or in combination with the above, exemplary embodiments of the invention provide an applicator comprising:

- a support with a longitudinal axis X, comprising: a stem; and a deformable portion including a first end and a second end, the deformable portion being arranged to deform elastically in a radial direction when a distance between the first and second ends is varied;
- an applicator member disposed between the first and second ends; and an adjuster element that is movable at least along the axis X relative to the support and that is arranged to adjust the distance between the first and second ends of the deformable portion. In exemplary embodiments, the adjuster element may be driven by a user by a control member located at an end of the applicator member.

In exemplary embodiments, the adjuster element may be turnable relative to the support. The support and the adjuster element may cooperate by screw engagement. The adjuster element may, for example, include a thread for cooperating with a complementary thread arranged on the support. For example, the support may have an inner threaded surface in a region of the first end or, alternatively or additionally, in a region of a handle member of the support.

In exemplary embodiments, the adjuster element may comprise a control member that projects from the support. The control member may project from the support in a region of the second end or, alternatively, may be in a region of a handle member of the support.

In exemplary embodiments, the control member may or may not be removably fastened on the handle member of the support. The control member may be configured to screw onto the handle member or, alternatively or additionally, to be snap-fastened on the handle member, or may be maintained by friction.

In exemplary embodiments, the control member may be turnable relative to the handle member and/or movable relative to the handle member parallel to a longitudinal axis of the applicator.

In exemplary embodiments, the adjuster element may include a stem that is not entirely rotationally symmetrical, and that may be received in a corresponding housing of the control member. For example, the stem may have a cross-section of polygonal, square, or other shape. Turning the control member may thus cause the adjuster element to turn.

In exemplary embodiments, the deformable portion of the support may comprise at least one longitudinally extending strip, such as a plurality of strips, for example, uniformly distributed around the longitudinal axis of the support. The strips may be four in number, for example.

In exemplary embodiments, the strips may have a part cylindrical shape in an unused position. In the unused position, the deformable portion of the support may thus have a substantially circular outside cross-section, but the case in which the deformable portion of the support has a cross-section of different shape, such as polygonal, is also contemplated by this invention.

In exemplary embodiments, the strips may have an outwardly domed shape in the unused position, for example, encouraging radially outward elastic deformation. Alternatively, the strips may have an inwardly dished shape, for example, encouraging radially inward elastic deformation.

In exemplary embodiments, the support may include a shoulder on which the applicator member may bear when the distance between the first and second ends decreases.

In exemplary embodiments, the applicator member may be molded as a single piece from an elastically deformable material. The applicator member may be produced from an elastomer or any other elastic material allowing compression and radial expansion of the applicator member.

For example, the applicator member may comprise a hollow cylindrical body, for example, made of an elastomer, and including external circular or polygonal ribs, or injection molded bristles, which may or may not be molded with the body.

In exemplary embodiments, deformation of the deformable portion may enable the distance between the ends of the applicator elements to be adjusted to regulate a quantity of substance retained on the applicator member and dispensed thereby.

When not deformed, an envelope surface of the applicator member may have a cross-section selected from the following non limiting list: circular and polygonal, such as square or triangular. When not deformed, the applicator member may have an envelope surface that passes through an extremum between axial ends thereof, for example, a maximum.

In exemplary embodiments, the applicator member may comprise a plurality of applicator elements engaged on the support, for example, a plurality of disks.

In exemplary embodiments, the plurality of disks may comprise disks of larger diameter alternating with disks of smaller diameter. When in place on the support, the larger-diameter disks may be of diameters that increase and then decrease with distance along the longitudinal axis of the support.

The term "disk" as used herein is to be construed in a broad sense. The term "disk" means any substantially flat element having thickness that is smaller than its other two dimensions. A disk in the context of this disclosure does not necessarily have a circular outline, nor is it necessarily completely flat. For example, the disks of the plurality of disks may have flat, tapered, concave, and/or convex faces, with the opposite faces of a disk being identical or different.

In exemplary embodiments, at least one applicator element, for example, one of the disks of said plurality of disks, may include an elastically deformable spacer applied against an adjacent applicator element to allow the applicator element to draw close to the adjacent applicator element when the distance between the first and second ends decreases.

In exemplary embodiments, the support and the applicator member may be made at least in part out of a same material, for example, an elastomeric material. At least one of the support and the applicator member may be made at least in part out of a material selected from thermoplastic resins and metals, such as stainless steel, for example. As indicated above, the support may include a handle member at one end of the stem. The handle member may comprise a cap for closing a receptacle containing a substance to be applied.

In exemplary embodiments, a largest transverse dimension of the applicator member may vary by a certain factor when the deformable portion changes from a state of zero deformation to a state of maximum deformation. This factor should not exceed the elastic limit for deformation of the material. Said factor may, for example, be in a range of about 1 to about 1.25 for a thermoplastic material. A maximum distance between the first and second ends may, for example, be in a range of about 0 to 35 millimeters (mm). A minimum distance between the first and second ends may, for example, be in a range of about 0 to about 26 mm.

In exemplary embodiments, the deformable portion may advantageously be produced integrally with the stem, for example, by molding.

Independently or in combination with the above, exemplary embodiments of the invention provide an applicator comprising:

a support with a longitudinal axis X, comprising: a stem; and a deformable portion formed as a single piece with the stem, the deformable portion including a first end and a second end, the deformable portion being arranged to deform elastically in a radial direction when a distance between the first and second ends is varied;

at least one applicator member disposed between the first and second ends; and an adjuster element that is movable at least along the axis X relative to the support and that is arranged to adjust the distance between the first and second ends of the deformable portion.

Independently or in combination with the above, exemplary embodiments of the invention provide a device for packaging and dispensing a substance, for example, a cosmetic, comprising: a receptacle containing the substance; and an applicator as defined above.

In exemplary embodiments, the device may also include a wiper member. The wiper member may include a minimum inside cross-section that is circular in shape.

In exemplary embodiments, the substance may be a cosmetic, makeup, or a care product, for example, mascara.

Independently or in combination with the above, exemplary embodiments of the invention provide a method of applying a substance, such as a cosmetic, said method comprising:

providing an applicator comprising:

a support comprising a stem with a longitudinal axis;

a deformable portion including a first end and a second end, the deformable portion being arranged to deform elastically in a radial direction when a distance between the first and second ends is varied;

an applicator member fitted between the first and second ends and extending continuously around the deformable portion; and an adjuster element that is movable relative to the support and that is arranged to adjust the distance between the first and second ends of the deformable portion; and adjusting the adjuster element to bring the applicator member into a predetermined configuration.

BRIEF DESCRIPTION OF THE DRAWINGS

The invention may be better understood from the following detailed description of non-limiting embodiments thereof, with reference to the accompanying drawings in which:

FIG. 1 is a diagrammatic longitudinal cross-sectional view of an exemplary packaging and dispenser device;

FIG. 2 is a fragmentary detail view in cross-section of the applicator of FIG. 1;

FIG. 9 is a fragmentary diagrammatic perspective view of another exemplary embodiment of an applicator;

FIG. 10 is a fragmentary diagrammatic longitudinal cross-sectional view of the applicator of FIG. 9;

FIGS. 11 to 13 are perspective views showing various exemplary embodiments of applicator members in isolation;

FIG. 14 is a fragmentary diagrammatic longitudinal cross-sectional view of another exemplary embodiment of an applicator;

FIG. 15 is a view analogous to FIG. 14 after modifying the distance between the first end and the second end;

FIGS. 16 to 18 are axial cross-sectional views of various exemplary disks shown in isolation;

FIG. 19 is a fragmentary diagrammatic longitudinal cross-sectional view of another exemplary embodiment; and FIGS. 20 and 21 show disks of the applicator of FIG. 19 in isolation.

DETAILED DESCRIPTION OF EMBODIMENTS

Figure 3:
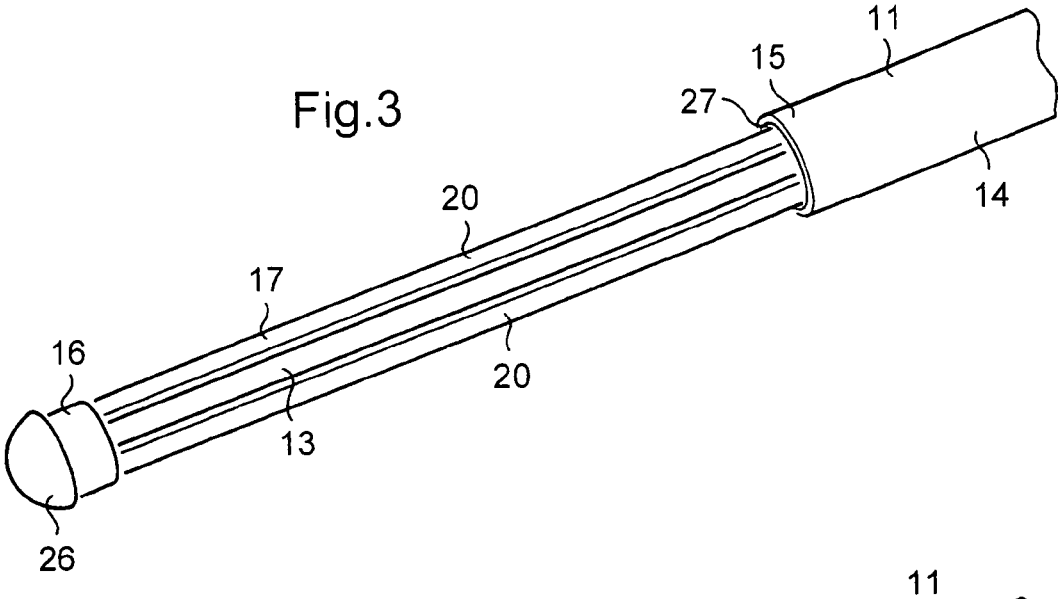
FIGS. 3 to 5 are fragmentary diagrammatic perspective views of the applicator of FIGS. 1 and 2 with different degrees of deformation of the deformable portion.

FIG. 1 shows an exemplary device 1 for packaging and dispensing a substance P, which may be a cosmetic, makeup, and/or a care product, for example, mascara, comprising a receptacle 2 containing the substance P.

The receptacle 2 may comprise a neck 4 in which a wiper member 5 is secured. The wiper member 5 may comprise a flange 6 that bears against an upper end of the neck 4 and a substantially conical wiper lip 7 that defines a smallest inside cross-section of the wiper member 5.

The device 1 may also comprise an applicator 10 comprising a support 11 extending along a longitudinal axis X, an applicator member 12 carried by the support 11, and an adjuster element 13 that is movable relative to the support 11.

The applicator 10 is shown in more detail in FIG. 2.

The support 11 may comprise a stem 14 extending along the longitudinal axis X with a top thereof connecting to a handle member 3 that, in the exemplary embodiment shown, may also serve as a cap for closing the receptacle 2 and may include a threaded skirt arranged to be screwed onto the neck 4. A bottom of the stem 14 may connect to a deformable portion 17 having a first end 15 adjacent to the stem 14 and a second end 16 opposite from the first end 15. In the exemplary embodiment shown, the deformable portion 17 may be formed as a single molding together with the stem 14.

The deformable portion 17 may deform elastically in a radial direction, i.e., perpendicular to the axis X, when the distance between the first end 15 and the second end 16 decreases. To this end, the deformable portion 17 may comprise strips 20 that, in the exemplary embodiment shown, may be four in number and may be equally distributed about the X axis, as shown in FIG. 3. The number of strips 20 may be different, for example, in a range of 2 to about 12, or in a range of about 3 to about 10.

The applicator member 12 may be disposed between the first end 15 and the second end 16, about the deformable portion 17. In the exemplary embodiment shown, the applicator member 12 may comprise a sleeve made of elastomer, carrying external applicator elements in the form of annular ribs 22 of outside diameter that increases and then decreases with distance along the longitudinal axis X of the support 11 between the ends 15 and 16.

In the exemplary embodiment shown, the stem 14 may be hollow and the adjuster element 13 may be free to turn therein. The present invention contemplates cases in which the adjuster element is movable relative to the support 11 with a motion other than rotation, for example, in translation alone. In the exemplary embodiment shown, the adjuster element 13 may extend to an upper end of the device and may comprise a control member 25 at that end. In the exemplary embodiment shown, the control member 25 may cooperate by screwing with the handle member 3.

At a lower end thereof, the adjuster element 13 may include a head 26 that bears axially on the second end 16 of the deformable portion 17.

When a user unscrews the control member 25 relative to the handle member 3, the adjuster element 13 may be turned about the axis X and may move upward along the axis X relative to the support 11.

Figure 4:
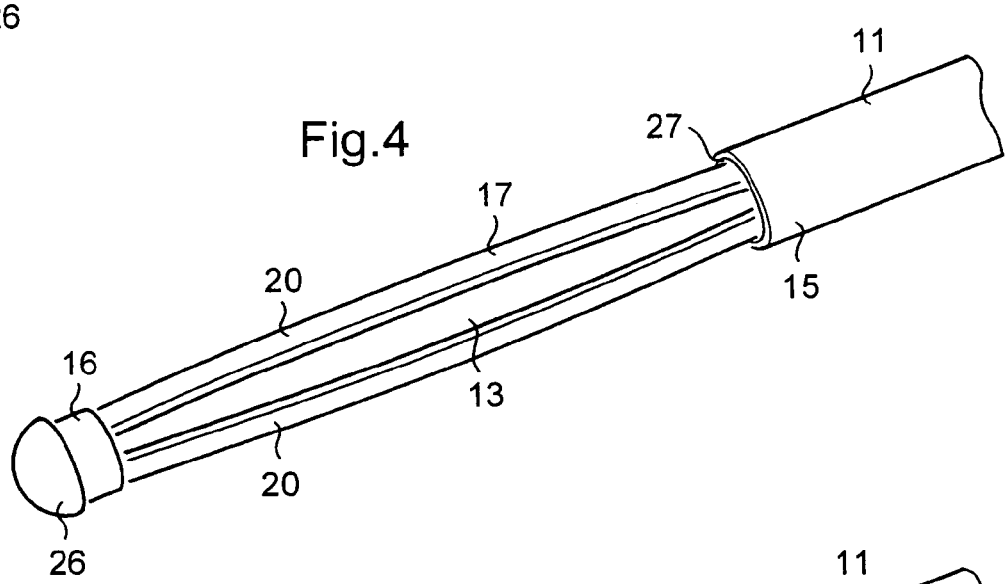

By moving toward the handle member 3, the head 26 may cause the first end 15 and the second end 16 to draw together, as shown in FIG. 4, causing radially outward deformation of the strips 20 in the exemplary embodiment shown.

In the unused position, the strips 20 may have the shape of a portion of a cylinder, for example, but the present invention contemplates the case in which the strips are outwardly domed in the unused position, which may encourage radially outward deformation of the deformable portion 17. The strips 20 may alternatively have an inwardly dished shape in the unused position, which may encouraging inward radial elastic deformation of the deformable portion 17.

Figure 5:
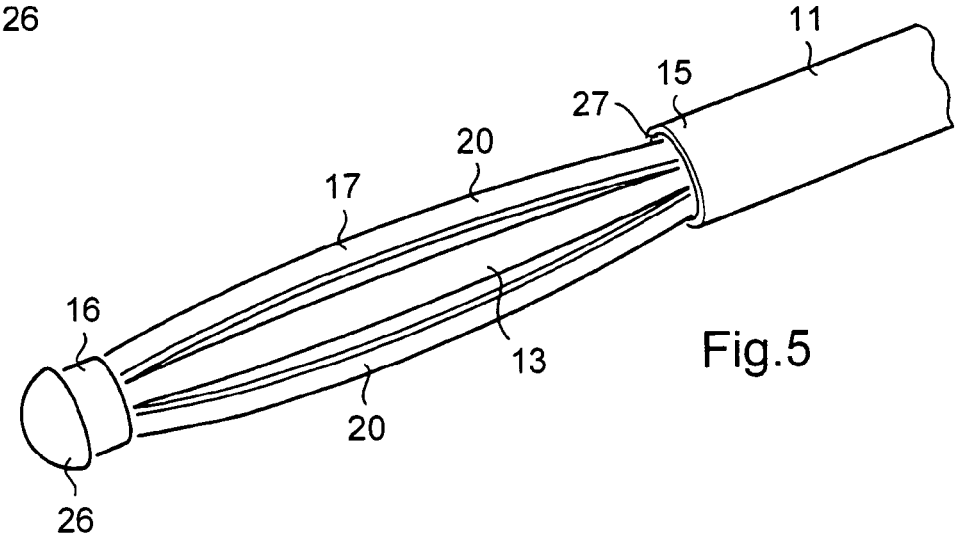

FIGS. 3 to 5 illustrate deformation of the deformable portion 17, without showing the applicator member 12 for the purposes of clarity, when the first end 15 and the second end 16 are drawn closer together.

Deformation of the strips 20 may cause deformation of the applicator member 12, which may deform elastically inwardly, the applicator member 12 being held axially, in the exemplary embodiment shown, between the head 26 of the adjusting member 13 and a shoulder 27 of the support 11, formed in the region of the first end 15.

The device 1 may be used as follows.

With the applicator 10 disposed in the receptacle 2, the user may turn the control member 25 to adjust the distance between the first end 15 and the second end 16 and bring the applicator member 12 into a desired shape.

The user may then unscrew the handle member 3 and remove the applicator 10. On passing through the wiper member 5, because of the smaller inside cross-section thereof, the applicator member 12 may be wiped to a greater or lesser extent depending on the outside diameter thereof, which in turn depends on the adjustment of the distance previously made.

When the first end 15 and the second end 16 are as close as possible, radial expansion of the applicator member 12 is at a maximum and wiping may be relatively severe. Extension, combing, and separation of the eyelashes may be improved as the ribs 22 are closer together and may, for example, grip eyelashes more effectively.

In contrast, when the first end 15 and the second end 16 are as far apart as possible, radial expansion of the applicator member 12 is at a minimum and wiping may be at a minimum, so that the quantity of substance that may be dispensed may thus be greater.

The applicator member 12 may be shaped at will simply by adjusting the control member 25, which means that the applicator member 12 may be adjusted to a curvature of eyelashes or eyebrows and to a desired type of makeup.

All intermediate positions between the two extreme positions described above are also possible, adjustment being possible in a continuous and progressive manner in the exemplary embodiment shown.

The handle member 3 and/or the control member 25 may, if appropriate or desired, comprise at least one indication for facilitating predetermined adjustment of the distance between the first end 15 and the second end 16. For example, the handle member 3 and/or the control member 25 may comprise at least one mark corresponding to a predefined distance between the first end 15 and the second end 16. The mark or marks may, for example, be in the form of icons representing the shape of the applicator device 12 when the first end 15 and the second end 16 are in the corresponding position.

The applicator member 12 may be made of a thermoplastic resin, for example, an elastomeric material. The support 11 may be made of a same material as the applicator member 12 or, alternatively, of another material.

The adjuster element 13 may or may not be monolithic and, for example, may be made at least in part out of a thermoplastic material or a metal.

The present invention contemplates the adjuster element 13 being made in a different manner as well.

Figure 6:
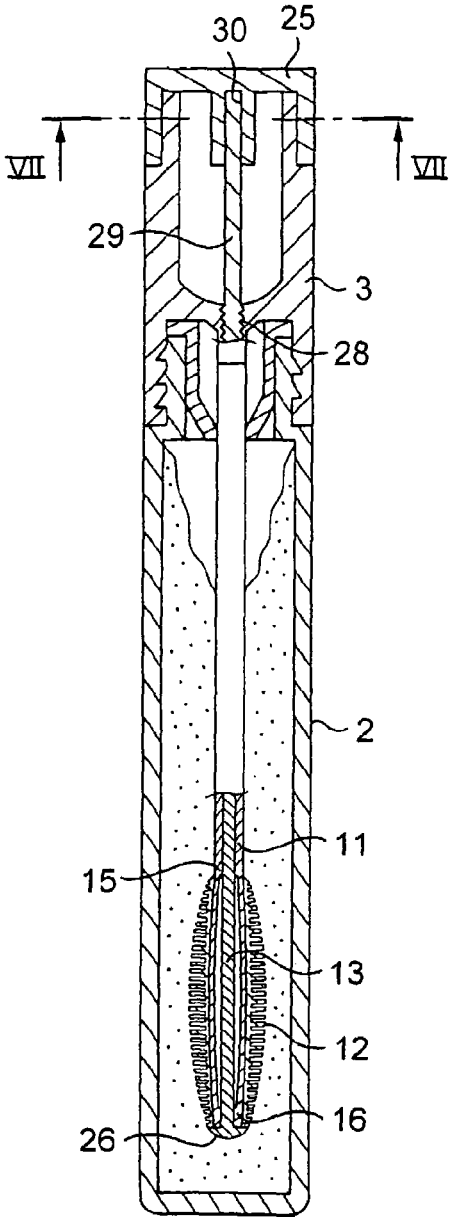
FIG. 6 is a diagrammatic longitudinal cross-sectional view of another exemplary embodiment.
Figure 7:
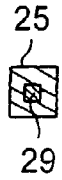
FIG. 7 is a fragmentary diagrammatic cross-sectional view taken along VII-VII in FIG. 6.

For example, FIG. 6 shows an adjuster element 13 comprising a stem 29 that may be secured at a top thereof to the control member 25, which may be rotatably and axially movable relative to the handle member 3. The stem 29 of the adjuster element 13 may cooperate with the support 11 by screwing, and to this end may include a thread 28 engaged in a complementary thread provided on the inside surface of the support, for example, in the handle member 3. The thread may be located elsewhere, for example, at the first end 15, or at another location. The stem 29 may not be entirely rotationally symmetrical having, for example, at least one square cross-section, as shown in FIG. 7. As shown, the stem 20 may be engaged in a corresponding housing 30 of the control member 25, so that when the control member 25 is turned relative to the handle member 3, the control member 25 may drive the stem 29 therewith, which may then be displaced axially relative to the support 11 by the thread 27, with the second end 16 drawing close to the first end 15.

Figure 8:
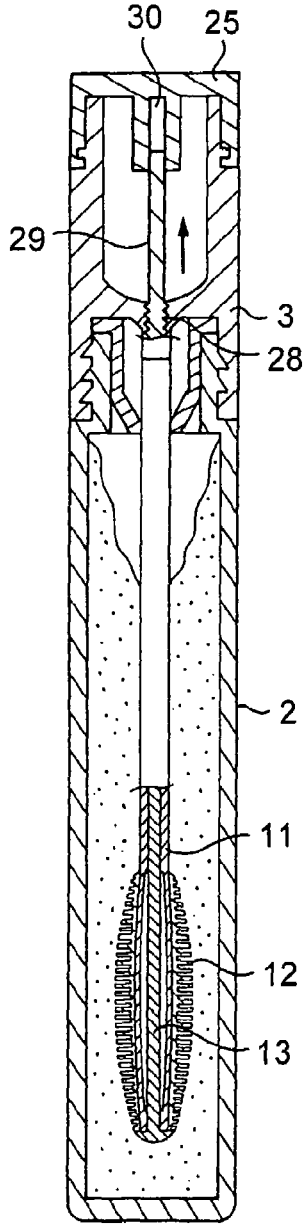
FIG. 8 is a diagrammatic longitudinal cross-sectional view of another exemplary embodiment.

Alternatively or additionally, the control member 25 may be snap-fastened on the handle member 3, as shown in FIG. 8, for example, so that the control member 25 is secured axially but may be turned relative to the handle member 3. In such embodiments, the stem 29 may move axially inside the housing 30 of the control member 25.

When the control member 25 is turned relative to the closure 3, the control member 25 may drive therewith the square-section stem 29, and the thread 27 may cause the adjuster element 13 to move up inside the housing 30.

In the exemplary embodiments described above, the control member 25 may project from the support 11 in the region of the handle member 3 of the applicator.

The present invention also contemplates the case in which the control member 25 projects from the support 11 at the second end 16, as shown in FIGS. 9 and 10, for example.

In the exemplary embodiment shown in FIGS. 9 and 10, the support 11 and the adjuster element 13 may cooperate by screw engagement, the thread 27 being located in the region of the first end 15.

The adjuster element 13 may be much shorter than in the exemplary embodiments described above and need not extend up to the handle member 3.

When the control member 25 is turned relative to the support 11 and the control member 25 bears axially against the second end 16, as shown in FIG. 10, the distance between the first end 15 and the second end 16 may be modified.

The applicator member 12 may be produced in different manners.

For example, FIG. 11 shows an exemplary applicator member 12 comprising a cylindrical hollow body 35 configured to be mounted on the deformable portion 17 and applicator elements in the form of bristles 36 which may be injection molded with the body 35.

FIG. 11 shows a single row of bristles 36 for greater clarity, but the applicator member 12 may include a plurality of rows of bristles 36, which may or may not be uniformly distributed, said rows possibly being parallel or perpendicular to the axis X, or may include bristles 36 disposed in a staggered pattern.

The surface envelope of the applicator member 12 may have a cross-section that is other than circular, for example, polygonal, such as triangular, as shown in FIG. 12, or square, as shown in FIG. 13.

In all of the exemplary embodiments described above, the applicator member 12 may be produced as a one-piece molding, but the present invention contemplates the applicator member being made as an assembly of independent applicator elements, for example, a stack of applicator elements in the form of disks.

For example, FIG. 14 shows an exemplary applicator 10 comprising a plurality of disks 40, which may be independent of each other. For greater clarity, FIG. 14 shows only four disks, but the applicator 10 may include a larger number of disks distributed along the deformable portion 17.

The disks 40 may be, for example, held between the head 26 of the adjuster element 13 and the shoulder 27 of the support 11.

Each disk 40 may include a central aperture allowing the disk 40 to be mounted on the deformable portion 17 of the support 11, and also may include at least one elastically-deformable spacer 42 that may space each disk apart from an adjacent disk while allowing the disks to approach each other when the distance between the first end 15 and the second end 16 decreases, as shown in FIG. 15.

Each spacer 42, as shown in FIG. 14 for example, may comprise an annular lip that is molded with the disk, extending in the unused position substantially parallel to the axis X, and capable of flexing as the disks move closer together.

The disk 40 may include a concave face and a convex face, as shown in FIG. 14, the lip 42 being connected, for example, to the convex face. Alternatively, the disk 40 may include a flat face and a convex face, as shown in FIG. 16.

FIG. 17 shows a disk with a spacer comprising two concentric lips 42.

The disk 40 shown in FIG. 18 includes two opposite faces that are substantially tapering, the disk becoming thinner toward a periphery thereof. The disk 40 shown in FIG. 18 may increase in diameter under pressure from the other disks when the first portion 15 and the second portion 16 draw together.

The disks shown include a circular outline, but the disks may alternatively include a polygonal outline.

As described above, all of the disks of an applicator may be identical, but the present invention contemplates the case in which an applicator 10 comprises different disks, for example, larger-diameter disks 45 alternating with smaller-diameter disks 46, as shown in FIG. 19.

For example, the larger-diameter disks 45, when placed on the support 11, may be of diameter that increases with distance along the longitudinal axis of the support toward the handle member 3 or, alternatively, with distance toward the second end 16.

The smaller-diameter disks 46 may all be identical, as in the exemplary embodiment shown, and may be of a shape that facilitates their radial deformation when the first 15 and second 16 ends are drawn together, for example, with annular grooves at their peripheries. Such a configuration may also further increase the quantity of substance retained by the applicator.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

Throughout the description, including in the claims, the expression "comprising a" should be understood to be synonymous with "comprising at least one", unless otherwise indicated.

What is claimed is:

1. An applicator comprising:

a support with a longitudinal axis, the support comprising:

a stem; and a deformable portion including a first end and a second end, the deformable portion being arranged to deform elastically in a radial direction when a distance between the first and second ends is varied;

an applicator member fitted to the deformable portion between the first and second ends and extending continuously around the deformable portion; and an adjuster element that is movable at least along the longitudinal axis relative to the support and that is arranged to adjust the distance between the first and second ends of the deformable portion, wherein the applicator member is molded as a single piece of an elastically deformable material.

2. An applicator comprising:

a support with a longitudinal axis, the support comprising:

a stem; and a deformable portion including a first end and a second end, the deformable portion being arranged to deform elastically in a radial direction when a distance between the first and second ends is varied;

an applicator member disposed between the first and the second ends; and an adjuster element that is movable at least along the longitudinal axis relative to the support and that is arranged to adjust the distance between the first and second ends of the deformable portion, the adjuster element being configured to be driven by a user by a control member located at an end of the applicator member, wherein the applicator member is molded as a single piece of an elastically deformable material.

3. An applicator according to claim 2, wherein the applicator member is fitted to the deformable portion of the support.

4. An applicator according to claim 1, wherein the adjuster element is turnable relative to the support.

5. An applicator according to claim 4, wherein the adjuster element comprises a thread configured to co-operating with a complementary thread provided on the support.

6. An applicator according to claim 5, wherein the support comprises an internally threaded surface in a region of the first end.

7. An applicator according to claim 1, wherein the support and the adjuster element cooperate by screw engagement.

8. An applicator according to claim 1, wherein the support comprises a handle member and an internally threaded surface in a region of said handle member.

9. An applicator according to claim 1, wherein the adjuster element comprises a control member that projects from the support.

10. An applicator according to claim 9, wherein the control member projects from the support in a region of the second end.

11. An applicator according to claim 9, wherein the control member projects from the support in a region of a handle member of the support.

12. An applicator according to claim 11, wherein the control member cooperates with the handle member.

13. An applicator according to claim 12, wherein the control member is configured to be screwed on the handle member.

14. An applicator according to claim 12, wherein the control member is snap fitted on the handle member.

15. An applicator according to claim 12, wherein the control member is turnable relative to the handle member.

16. An applicator according to claim 12, wherein the control member is movable relative to the handle member in a direction substantially parallel to a longitudinal axis of the applicator.

17. An applicator according to claim 12, wherein the adjuster element comprises a stem that is not entirely rotationally symmetrical and is secured in a housing in the control member.

18. An applicator according to claim 1, wherein the deformable portion comprises at least one longitudinally extending strip.

19. An applicator according to claim 18, wherein the deformable portion comprises a plurality of strips distributed equally about the longitudinal axis of the support.

20. An applicator according to claim 18, wherein, in an unused position, the strips are substantially in a shape of a portion of a cylinder.

21. An applicator according to claim 1, wherein the support comprises a shoulder on which the applicator member is arranged to bear when the distance between the first and second ends decreases.

22. An applicator according to claim 1, wherein a surface envelope of the applicator member, when not deformed, has a cross-section selected from circular, polygonal, square and triangular.

23. An applicator according to claim 1, wherein a surface envelope of the applicator member has a cross-section that passes through an extremum between axial ends thereof when not deformed.

24. An applicator according to claim 23, wherein said extremum is a maximum.

25. An applicator according to claim 1, wherein the applicator member comprises a plurality of applicator elements engaged on the support.

26. An applicator comprising:

a support with a longitudinal axis, the support comprising: a stem; and a deformable portion including a first end and a second end, the deformable portion being arranged to deform elastically in a radial direction when a distance between the first and second ends is varied;

an applicator member fitted to the deformable portion between the first and second ends and extending continuously around the deformable portion; and an adjuster element that is movable at least along the longitudinal axis relative to the support and that is arranged to adjust the distance between the first and second ends of the deformable portion, wherein the support and the applicator member are made at least in part out of a same material.

27. An applicator according to claim 26, wherein said material comprises an elastomeric material.

28. An applicator according to claim 27, wherein the support comprises a handle member at one end of the stem.

29. An applicator according to claim 28, wherein the handle member comprises a cap for closing a receptacle containing a substance to be applied.

30. An applicator according to claim 1, wherein a largest transverse dimension of the applicator member varies by a factor of 1 to 1.25 when the deformable portion passes from a zero deformation state to a maximum deformation state.

31. An applicator according to claim 1, wherein the deformable portion is formed monolithically with the stem.

32. A device for packaging and dispensing a substance, comprising:

a receptacle containing a substance; and an applicator according to claim 1.

33. A device according to claim 32, further comprising a wiper member.

34. A device according to claim 33, wherein the wiper member has a smallest inside cross-section that is circular in shape.

35. A device according to claim 32, wherein the substance comprises at least one of a cosmetic, makeup, a mascara and a care product.

* * * * *